US006976344B2

(12) United States Patent
Sanger

(10) Patent No.: US 6,976,344 B2
(45) Date of Patent: Dec. 20, 2005

(54) METHOD OF ASSEMBLING CONCRETE PANEL BUILDING MODULE WITH CONNECTION PLATES AND RESULTING MODULE

(76) Inventor: Wallace D. Sanger, 11333 Acme Rd., West Palm Beach, FL (US) 33414

( * ) Notice: Subject to any disclaimer, the term of this patent is extended or adjusted under 35 U.S.C. 154(b) by 0 days.

(21) Appl. No.: 10/163,665

(22) Filed: Jun. 6, 2002

(65) Prior Publication Data

US 2003/0226326 A1 Dec. 11, 2003

(51) Int. Cl.[7] ..... E04B 1/00; E04G 21/00

(52) U.S. Cl. ..... 52/741.1; 52/270; 52/578; 52/745.13; 52/745.19

(58) Field of Search ..... 52/285.1, 285.4, 52/270, 271, 578, 80, 745.13, 588.1, 582.1, 741.1, 745.14, 745.19, 750, 745.05, 745.211, 746.11

(56) References Cited

U.S. PATENT DOCUMENTS 3,665,662 A * 5/1972 Timbrook et al. ..... 52/210
3,685,229 A * 8/1972 Sale et al. ..... 52/783.16
3,827,203 A * 8/1974 Berrie ..... 52/79.11
3,919,825 A * 11/1975 Smith et al. ..... 52/745.13
3,942,294 A * 3/1976 Savell, Jr. ..... 52/259
3,987,597 A * 10/1976 Smrt ..... 52/764
3,988,868 A * 11/1976 Labie et al. ..... 52/236.6
4,185,423 A * 1/1980 Gutierrez ..... 52/79.9
4,280,307 A * 7/1981 Griffin ..... 52/92.1
4,441,293 A * 4/1984 McQueen et al. ..... 52/377
4,545,169 A * 10/1985 Rizk ..... 52/601
4,557,099 A * 12/1985 Johnson ..... 52/745.14
4,580,385 A * 4/1986 Field ..... 52/578
5,195,293 A * 3/1993 diGirolamo et al. ..... 52/745.13
5,493,836 A * 2/1996 Lopez-Munoz ..... 52/602
5,678,372 A * 10/1997 Thomson et al. ..... 52/432
5,689,929 A * 11/1997 Newsom ..... 52/648.1
5,732,520 A * 3/1998 Maietta ..... 52/483.1
5,813,175 A * 9/1998 Hiragaki ..... 52/167.1
6,209,284 B1 * 4/2001 Porter ..... 52/794.1
6,613,984 B1 * 9/2003 Hensley ..... 174/138 G

* cited by examiner

*Primary Examiner*—Jeanette Chapman
(74) *Attorney, Agent, or Firm*—Frank L. Kubler

(57) ABSTRACT

A method of constructing building module and resulting building module are provided, the building module including a building floor panel oriented substantially horizontally; a number of exterior wall panels having exterior wall panel faces and exterior wall panel ends, the exterior wall panels being positioned upright and end to end on the floor panel to form an enclosure; a number of wall panels having wall panel connection plates having a plate connection structure and having a plate anchor structure embedded in exterior wall panel faces at exterior side wall panel ends, the plate connection structure registering with and being immediately adjacent and welded to wall panel connection plates of adjacent exterior wall panels; and at least one roof panel having roof panel faces and roof panel ends and resting on top of a number of the exterior wall panels and having roof connection plates with plate connection structures registering with and being immediately adjacent and welded to plate connection structures of a number of the wall panel connection plates of adjacent exterior wall panel ends.

4 Claims, 5 Drawing Sheets

METHOD OF ASSEMBLING CONCRETE PANEL BUILDING MODULE WITH CONNECTION PLATES AND RESULTING MODULE

BACKGROUND OF THE INVENTION

1. Field of the Invention

The present invention relates generally to the field of building construction elements and methods. More specifically the present invention relates to a method of assembling a concrete building module including the steps of providing a number of metal or plastic connection plates, separating the connection plates into groups of wall panel connection plates and roof panel connection plates, each connection plate having a plate connection means and having a plate anchor means; pre-casting with concrete a number of exterior wall panels having exterior wall panel faces and exterior wall panel ends with the plate anchor means of at least one wall panel connection plate embedded in a wall panel face of each at least one exterior wall panel such that the wall panel connection plate is adjacent an external wall panel end; pre-casting with concrete a roof panel having roof panel face and roof panel ends with the anchor means of a number of roof panel connection plates embedded in a roof panel face of the roof panel such that the connection plates are adjacent to a roof panel end; forming a floor panel; placing the exterior wall panels upright and end to end along the perimeter of the floor panel to define an enclosure such that connection plates of adjacent wall panels register with and are immediately adjacent to each other; welding the adjacent wall panel connection plates together to secure the wall panels in their positions relative to each other; placing the roof panel across and on top of the wall panels such that roof panel connection plates register with and are immediately adjacent to wall panel connection plates; welding adjacent wall panel and roof panel connection plates together to secure the one roof panel and wall panels in their positions relative to each other to define a concrete building module.

The module formed according to this method includes a building foundation slab; a number of exterior wall panels having exterior wall panel faces and exterior wall panel ends, the exterior wall panels being positioned upright and end to end on the floor panel to form an enclosure, each exterior wall panel having wall panel connection plates embedded in wall exterior panel faces at exterior side wall panel ends registering with and being immediately adjacent and welded or melted to wall panel connection plates of adjacent exterior wall panels; at least one roof panel having roof panel ends and resting on top of the exterior wall panels and having roof panel connection plates registering with and being immediately adjacent and welded to wall panel connection plates of adjacent exterior wall panel ends.

The plate connection means preferably includes a substantially planar metal or plastic plate having a plate first end and a plate second end. The connection plate anchor means preferably include two plate faces and at least one, and preferably two, plate anchor projections extending outwardly and preferably perpendicularly from the plate first face. The roof panel preferably is an inventive monolithic peaked roof panel, in the form of two planar panels formed in a single casting to be monolithically interconnected at common panel ends to form the wide V-shaped cross-section of a peaked roof 2. Description of the Prior Art There have long been buildings and building modules formed of pre-cast concrete wall panels tilted upright on a foundation slab. In some instances, concrete roof panels have been placed on top of the tilt-up concrete wall panels. A problem with assembling these structures has been in interconnecting the wall panels with interconnection means which are strong enough to meet building codes and safety requirements and yet which can be installed and interconnected quickly and efficiently with minimal worker skill.

It is thus an object of the present invention to provide a building module which is constructed of individual pre-cast concrete panels and is assembled with panel interconnection means which cause the building module to be sturdy and reliable.

It is another object of the present invention to provide such a building module which has interconnection means which can be joined quickly, with conventional tools and with minimal worker skill.

It is still another object of the present invention to provide an interconnection means for interconnecting concrete panels which is inexpensive to manufacture and to incorporate into a concrete panel during panel casting and which can be joined to another such interconnection means quickly, with conventional tools and with minimal worker skill.

It is yet another object of the present invention to provide a method of assembling such a building module from pre-cast concrete panels by interconnecting the concrete panels with such interconnection means.

It is finally an object of the present invention to provide such a method of assembling such a building module with a pre-cast monolithic peaked concrete roof panel.

SUMMARY OF THE INVENTION

The present invention accomplishes the above-stated objectives, as well as others, as may be determined by a fair reading and interpretation of the entire specification.

A method is provided of constructing a concrete building module, including the steps of providing a number of metal connection plates including groups of wall panel connection plates and roof panel connection plates, each connection plate having a plate connection structure and a plate anchor structure; pre-casting with concrete a number of exterior wall panels having exterior wall panel faces and exterior wall panel ends with the plate anchor structures of at least one wall panel connection plate embedded in an exterior wall panel face of each at least one exterior wall panel so that the wall panel connection plate is adjacent an exterior wall panel end; pre-casting with concrete at least one roof panel having roof panel faces and roof panel ends with the plate anchor structures of at least one roof connection plate embedded in a roof panel face of the at least one roof panel so that the at least one roof connection plate is adjacent a roof panel end; forming a horizontal floor panel; placing the exterior wall panels upright and end to end on the floor panel to define an enclosure so that connection plates of adjacent wall panels register with and are immediately adjacent to each other; welding adjacent wall panel connection plates together to secure the exterior wall panels in their positions relative to each other; placing the at least one roof panel across and on top of a number of the exterior wall panels so that the roof panel connection plates register with and are immediately adjacent to the wall panel connection plates; and welding adjacent at least one wall panel and roof panel connection plates together to secure the at least one roof panel and exterior wall panels in their positions relative to each other to define a concrete building module.

The method preferably includes the additional steps of pre-casting with concrete at least one interior wall panel having interior wall panel faces and interior wall panel ends with the plate anchor structure of at least one wall panel connection plate embedded in a face of the at least one interior wall panel so that the connection plate is adjacent to an interior wall panel end; placing the at least one interior wall panel within the enclosure defined by the exterior wall panels to define a module interior wall, so that the at least one wall panel connection plate of the interior wall panel registers with and is immediately adjacent to one of: a wall panel connection plate of another interior wall panel and an wall panel connection plate of one of the exterior wall panels; and welding the adjacent plate connection structures together to secure the at least one interior wall panel in its position relative to the exterior wall panels.

A building module is provided, including a building floor panel oriented substantially horizontally; a number of exterior wall panels having exterior wall panel faces and exterior wall panel ends, the exterior wall panels being positioned upright and end to end on the floor panel to form an enclosure; a number of wall panels having wall panel connection plates having a plate connection structure and having a plate anchor structure embedded in exterior wall panel faces at exterior side wall panel ends, the plate connection structure registering with and being immediately adjacent and welded to wall panel connection plates of adjacent exterior wall panels; and at least one roof panel having roof panel faces and roof panel ends and resting on top of a number of the exterior wall panels and having roof connection plates with plate connection structures registering with and being immediately adjacent and welded to plate connection structures of a number of the wall panel connection plates of adjacent exterior wall panel ends.

The module preferably additionally includes at least one interior wall panel having interior wall panel faces and interior wall panel ends and at least one wall panel connection plate having a plate connection structure and having a plate anchor structure embedded in an interior wall panel face adjacent to one of the interior wall panel ends; the interior wall panel being secured within the enclosure defined by the exterior wall panels and defining a module interior wall, so that the at least one wall panel connection plate of the interior wall panel registers with and is immediately adjacent and welded to a plate connection structure of one of: a wall panel connection plate of another the interior wall panel and a wall panel connection plate of an external wall panel.

The at least one roof panel preferably includes a monolithic peaked roof panel in the form of two planar panels formed in a single casting to be monolithically interconnected at common panel ends to form a V-shaped cross-section. The roof panel preferably has a roof panel lower face and the interior wall panels are sized in height to continually meet the roof panel lower face. The interior wall panels and the exterior wall panels preferably include one of: a door opening and a window opening. The exterior wall panels preferably are anchored to the floor panel with anchor mean.

A panel connection plate for interconnecting pre-cast concrete building module panels, including a plate connection means including a plate having a plate first face and a plate second face; at least one plate anchor projection extending outwardly from the plate first face for embedding into a concrete building panel during panel casting. The at least one anchor projection preferably includes a shank having a shank connected end welded to the plate first face and having a shank free end with a radially projecting shank head for engaging and locking into panel concrete.

A method of constructing a concrete building module, including the steps of providing a number of plastic connection plates including groups of wall panel connection plates and roof panel connection plates, each connection plate having a plate connection structure and a plate anchor structure; pre-casting with concrete a number of exterior wall panels having exterior wall panel faces and exterior wall panel ends with the plate anchor structure of at least one wall panel connection plate embedded in an exterior wall panel face of each at least one exterior wall panel so that the wall panel connection plate is adjacent an exterior wall panel end; pre-casting with concrete at least one roof panel having roof panel faces and roof panel ends with the plate anchor structure of at least one roof connection plate embedded in a roof panel face of the at least one roof panel so that the at least one roof connection plate is adjacent a roof panel end; forming a horizontal floor panel; placing the exterior wall panels upright and end to a end on the floor panel to define an enclosure so that connection plates of adjacent wall panels register with and are immediately adjacent to each other; melting adjacent wall panel connection plates together to secure the exterior wall panels in their positions relative to each other; placing the at least one roof panel across and on top of a number of the exterior wall panels so that roof panel connection plates register with and are immediately adjacent to wall panel connection plates; and melting adjacent at least one wall panel and roof panel connection plates together to secure the at least one roof panel and exterior wall panels in their positions relative to each other to define a concrete building module.

A method of constructing a concrete building module, including the steps of providing a number of connection plates including groups of wall panel connection plates and roof panel connection plates, each connection plate having a plate connection structure and a plate anchor structure; pre-casting with concrete a number of exterior wall panels having exterior wall panel faces and exterior wall panel ends with the plate anchor structure of at least one wall panel connection plate embedded in an exterior wall panel face of each at least one exterior wall panel so that the wall panel connection plate is adjacent an exterior wall panel end; pre-casting with concrete at least one roof panel having roof panel faces and roof panel ends with the plate anchor structure of at least one roof connection plate embedded in a roof panel face of the at least one roof panel so that the at least one roof connection plate is adjacent a roof panel end; forming a horizontal floor panel; placing the exterior wall panels upright and end to end on the floor panel to define an enclosure so that connection plates of adjacent wall panels register with and are immediately adjacent to each other; securing adjacent the wall panel connection plates together to secure the exterior wall panels in their positions relative to each other; placing the at least one roof panel across and on top of a plurality of the exterior wall panels so that roof panel connection plates register with and are immediately adjacent to wall panel connection plates; and securing adjacent the at least one wall panel and roof panel connection plates together to secure the at least one roof panel and exterior wall panels in their positions relative to each other to define a concrete building module.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
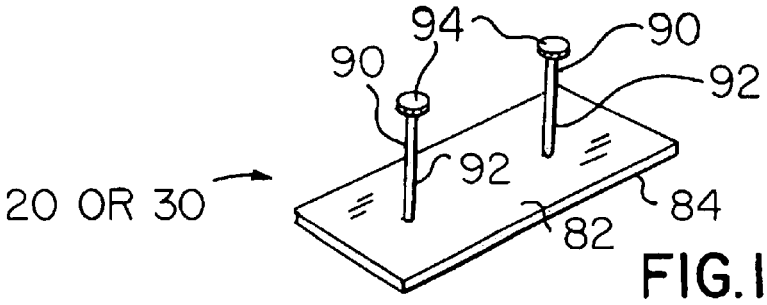
FIG. 1 is a perspective view of a wall panel connection plate or roof panel connection plate.
Figure 2:
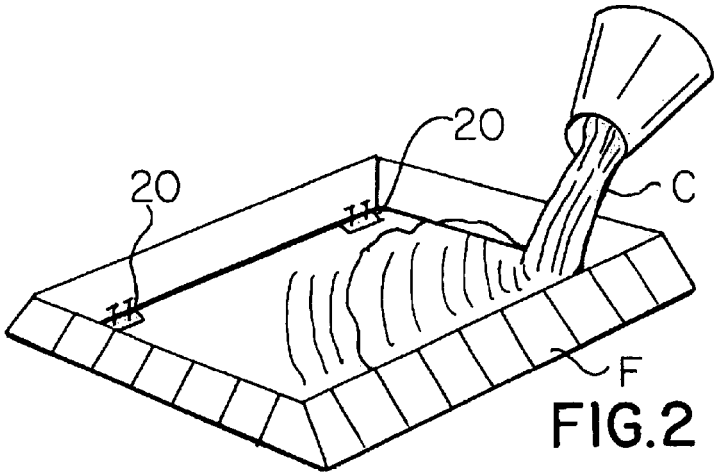
FIG. 2 is a perspective view of flowable concrete being poured into a form having wall panel connection plates along each form side wall to cast a wall panel with connection plate projections embedded in the wall panel concrete.
Figure 3:
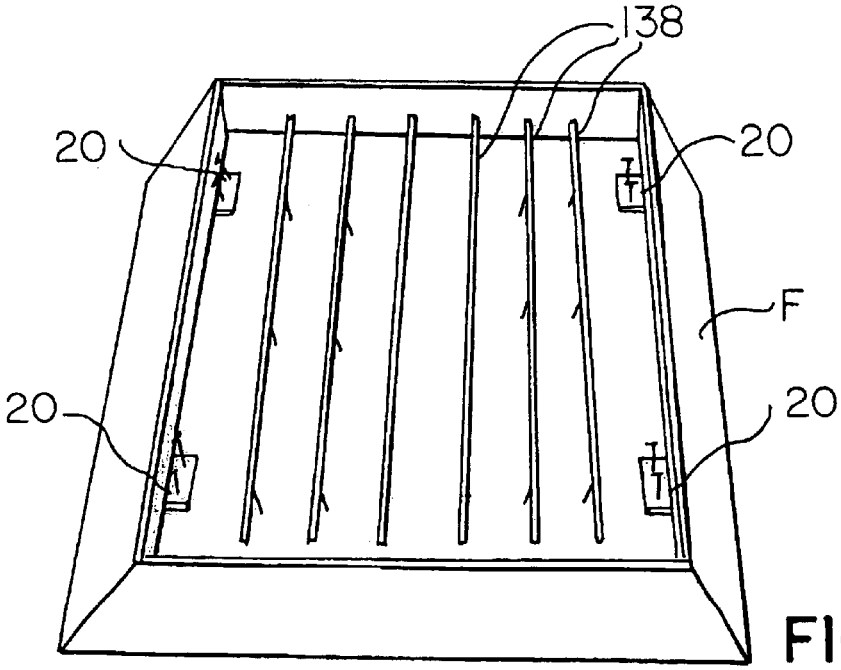
FIG. 3 is another perspective view of a wall panel form prior to concrete pouring, having the wall panel connection plates in position and standard reinforcing rods on reinforcing rod stands.
Figure 4:
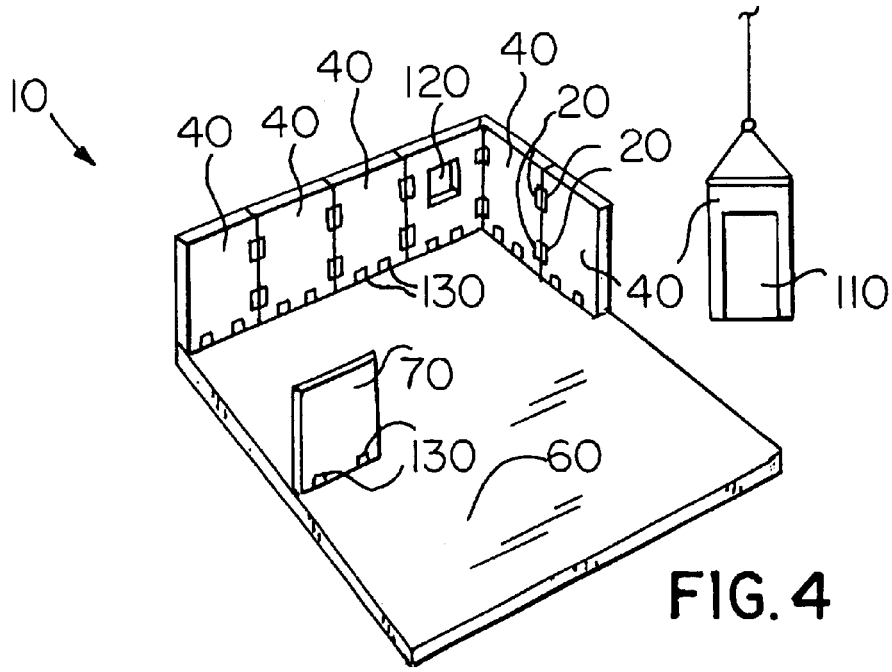
FIG. 4 is a perspective view of a module being assembled, showing the floor panel, several exterior wall panels secured end to end along the floor panel perimeter with floor panel anchors and wall panel connection plates, a single interior wall panel anchored in place, and an exterior wall panel having a door opening being lowered from a crane for placement along the floor panel perimeter.
Figure 5:
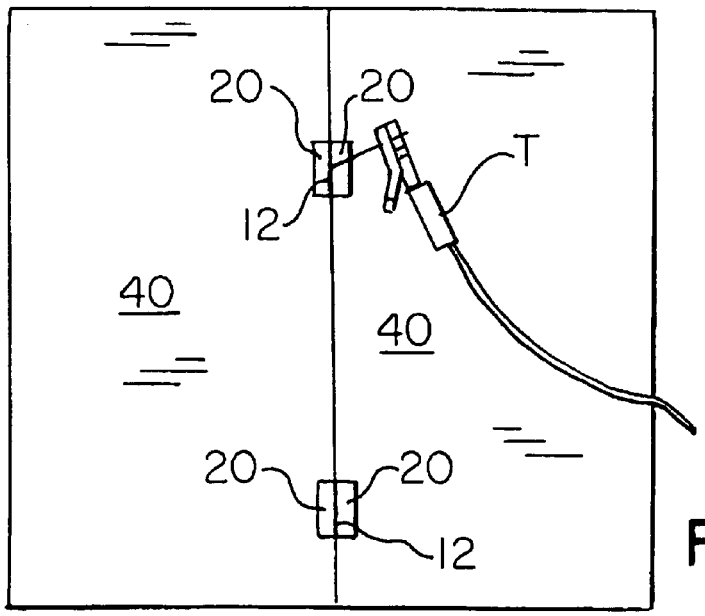
FIG. 5 is a front view of two interior or exterior wall panels being interconnected at their abutted ends by welding together of their wall panel connection plates.
Figure 6:
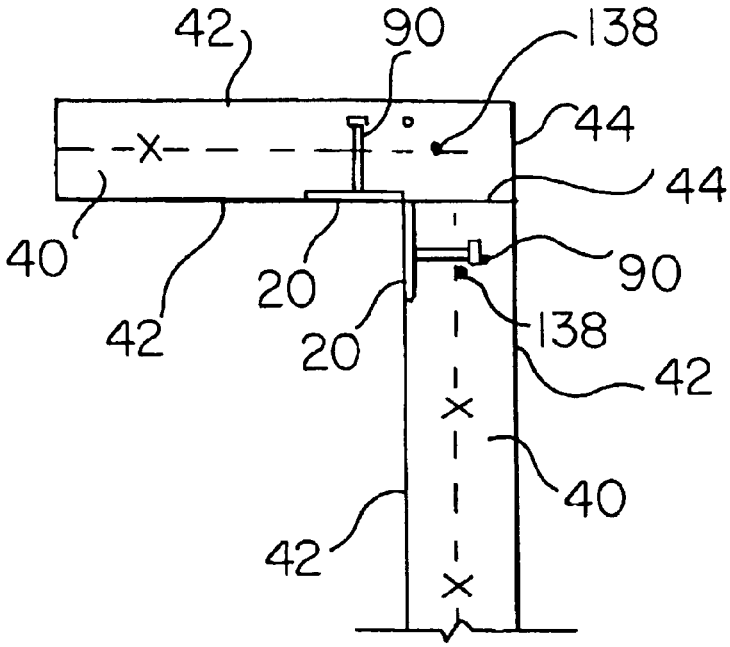
FIG. 6 is a cross-sectional top view of two upright and perpendicularly intersecting and abutting interior or exterior wall panels and of the abutting and welded or melted together wall panel connection plates. Note that since the panels for a corner by one overlapping an end of the other, the wall panel connection plate of the overlapping wall panel is set back from the adjacent panel end to be positioned to meet the wall panel connection plate of the other wall panel.
Figure 7:
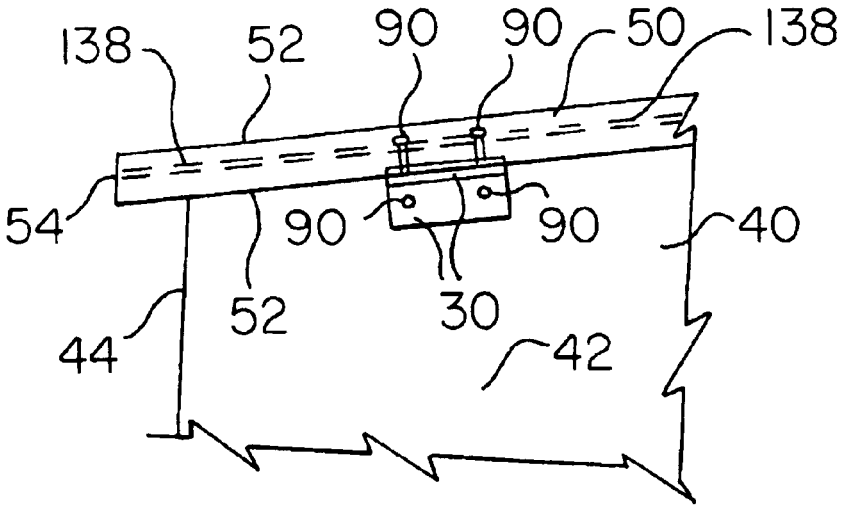
FIG. 7 is a partial front view of an interior or exterior wall panel and a segment of roof panel resting on top of the wall panel, and of roof panel connection plates interconnected with a weld or melt line.
Figure 8:
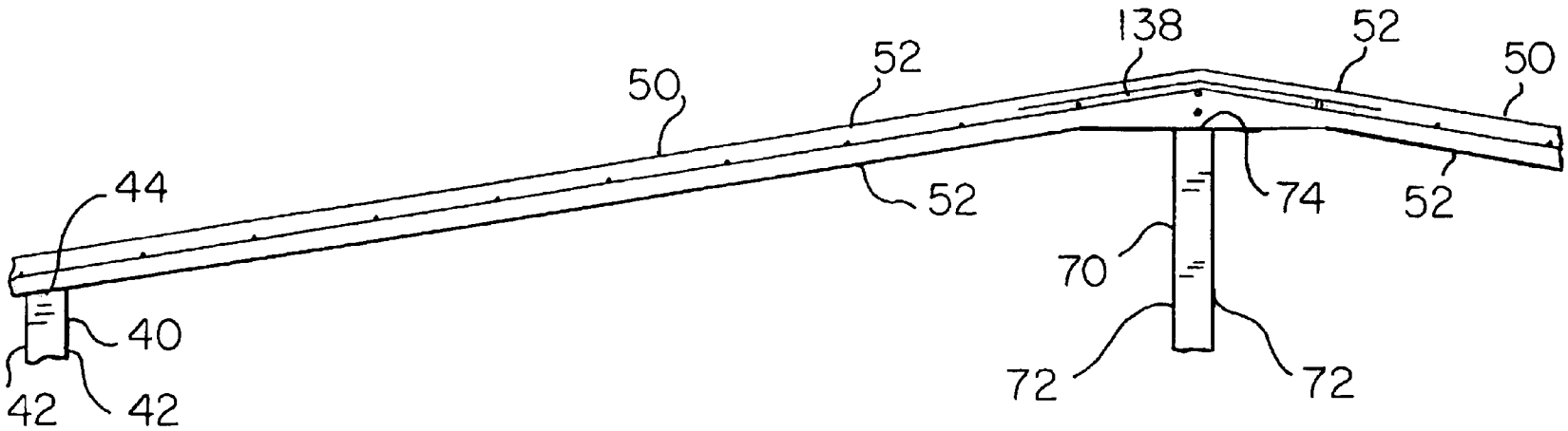
FIG. 8 is a partial end view of an interior wall panel and of an exterior wall panel spaced apart and set upright to form a module, and a partial end view of a monolithic roof panel resting on top of the interior wall panel and the exterior wall panel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Method

Figure 10:
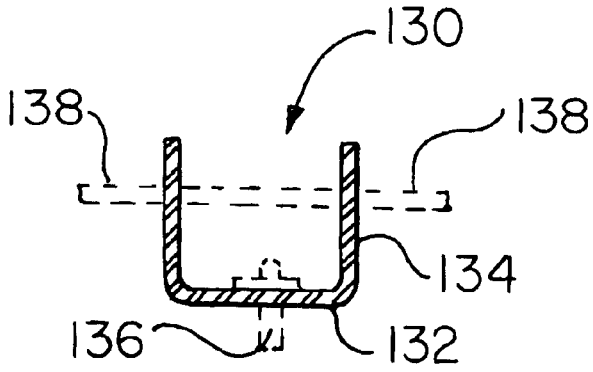
FIG. 10 is a cross-sectional front view of a floor slab anchor, showing in broken lines a floor slab anchor bolt in the floor slab anchor bottom segment and in broken lines a reinforcing rod passing through the floor slab anchor side segments.
Figure 9:
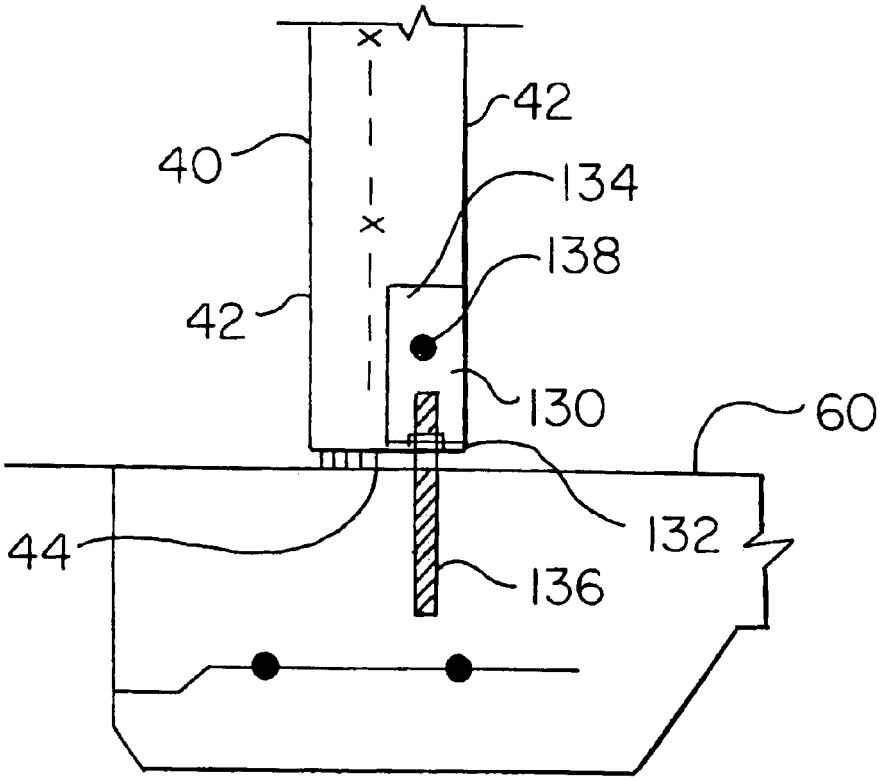
FIG. 9 is a cross-sectional end view of an interior or exterior wall panel and of a floor slab anchor securing the wall panel to the floor slab.

In practicing the invention, the following method may be used. See FIGS. 1–5. A method of assembling a method of assembling a concrete building module 10 including the steps of providing a number of connection plates, separating the connection plates into groups of wall panel connection plates 20 and roof panel connection plates 30, each connection plate 20 and 30 having plate connection means and having a plate anchor means; pre-casting with concrete C in forms F a number of exterior wall panels 40 having exterior wall panel faces 42 and exterior wall panel ends 44 with the plate anchor means of at least one wall panel connection plate 20 embedded in or other wise secured to a wall panel face 42 of each at least one exterior wall panel 40 such that the wall panel connection plate 20 is adjacent to an external wall panel end 44; pre-casting with concrete a roof panel 50 having roof panel faces 52 and roof panel ends 54 with the anchor means of a number of roof panel connection plates 30 embedded in a roof panel face 52 of the roof panel 50 such that the connection plates 30 are adjacent a roof panel end 54; forming a floor panel 60; placing the exterior wall panels 40 upright and end to end along the perimeter of the floor panel 60 to define an enclosure such that wall panel connection plates 20 of adjacent exterior wall panels 40 register with and are immediately adjacent to each other; welding or melting the adjacent wall panel connection plates 20 together to secure the exterior wall panels 40 in their positions relative to each other such as with a welding torch T to form a connecting weld or melt line 12; placing the roof panel 50 across and on top of the exterior wall panels 40 such that roof panel connection plates 30 register with and are immediately adjacent to wall panel connection plates 20; welding adjacent wall panel and roof panel connection plates 20 and 30 together to secure the one roof panel 50 and exterior wall panels 40 in their positions relative to each other to define a concrete building module 10. Exterior and interior wall panels 40 and 70, respectively, are preferably secured to the floor panel 60 with floor anchors 130, each preferably taking the form of a U-shaped plate having a slab anchor bolt port in its U-shaped plate bottom segment 132 through which an anchor bolt 136 is passed and having directly opposing and registering reinforcing bar passing ports in the U-shaped plate side segments 134 through which a reinforcing rod 138 is passed during wall panel 20 or 30 forming. See FIGS. 9 and 10.

Optional additional steps are: embedding or otherwise securing a wall panel connection plate anchor means into an exterior wall panel face 42 between exterior wall panel ends 44; pre-casting with concrete at least one interior wall panel 70 having interior wall panel faces 72 and interior wall panel ends 74 with the plate anchor means of a number of wall panel connection plates 20 embedded in a face 72 of the interior wall panel 70 adjacent to an interior wall panel end 74; placing the interior wall panel 70 within the enclosure defined by the exterior wall panels 40 to form module interior wall, such that the wall panel connection plates register with and are immediately adjacent to one of: a wall panel connection plate 20 of another interior wall panel 70 and a wall panel connection plate 20 on an exterior wall panel 40 between exterior wall panel ends 44; welding or melting adjacent wall panel connection plates 20 together to secure the interior wall panel 70 in its position relative to the exterior wall panels 40.

Preferred Embodiment of Building Module

Referring to FIGS. 1–10, a building module 10 is disclosed which is constructed according to the above-referenced method and which includes a building floor panel 60; a number of exterior wall panels 40 having exterior wall panel faces 42 and exterior wall panel ends 44, the exterior wall panels 40 being positioned upright and end to end on the floor panel 60 to form an enclosure, each exterior wall panel 40 having wall panel connection plates 20 embedded in wall exterior panel faces 42 at exterior side wall panel ends 44 registering with and being immediately adjacent and welded or melted to wall panel connection plates 20 of adjacent exterior wall panels 40; at least one roof panel 50 having roof panel faces 52 and roof panel ends 54 and resting on top of the exterior wall panels 40 and having roof panel connection plates 30 registering with and being immediately adjacent and welded or melted to wall panel connection plates 20 of adjacent exterior wall panel ends 44. The module 10 preferably also includes wall panel connection plates 20 embedded in an exterior wall panel face 42 between the exterior wall panel ends 44; at least one interior wall panel 70 having interior wall panel faces 72 and interior wall panel ends 74 and the anchor means of at least one wall panel connection plate 20 embedded in an interior wall panel face 72 adjacent to one of the interior wall panel ends 74; the interior wall panel 70 being secured within the enclosure defined by the exterior wall panels 40 and forming a module interior wall, such that the wall panel connection plate 20 registers with and is immediately adjacent and welded to one of: a wall panel connection plate 20 of another interior wall panel 70 and a wall panel connection plate 20 at an exterior wall panel 40.

Preferred Embodiment of Plate Anchor Means

The plate connection means preferably each include either a wall panel connection plate 20 or a roof panel connection plate 30 in the form of a substantially planar metal or plastic plate having a plate first face 82 and a plate second face 84. See FIG. 1. The connection plate anchor means preferably each include at least one, and preferably two, plate anchor projections 90 extending outwardly and preferably perpendicularly from the plate first face. Each anchor projection 90 preferably is a shank having a shank 92 connected end welded to the plate first face and having a shank free end with a radially projecting shank head 94 to engage and lock into panel 40, 50 or 70 concrete. The roof panel 50 preferably is an inventive monolithic peaked roof panel, in the form of two planar panels formed in a single casting to be monolithically interconnected at common panel ends to form the wide V-shaped cross-section of a peaked roof, which has greater strength than two conventionally interconnected planar roof panels and which assures nonleakage at the roof panel peak. In the event that the roof panel or panels 50 form a peaked roof, exterior wall panels 40 are sized in height and contoured to form shorter end walls at roof ends and to form upwardly angled side walls to follow the incline of the roof. Interior wall panels 70 are sized in height to continually meet the lower surface of the roof panel or panels 50. The interior and exterior wall panels 40 and 70, respectively, optionally include door and window openings 110 and 120, respectively. The exterior and interior wall panels 40 and 70 are anchored to the building floor panel 60 with any of numerous conventional means known in the art of building construction.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of constructing a concrete building module, comprising the steps of:

providing a plurality of metal connection plates comprising groups of wall panel connection plates and roof panel connection plates, each connection plate having a plate connection means and a plate anchor means;

pre-casting with concrete a plurality of exterior wall panels having exterior wall panel faces and exterior wall panel ends with the plate anchor means of at least one said wall panel connection plate embedded in an exterior wall panel face of each at least one exterior wall panel such that the wall panel connection plate is adjacent an exterior wall panel end;

pre-casting with concrete at least one roof panel having roof panel faces and roof panel ends with the plate anchor means of at least one said roof connection plate embedded in a roof panel face of said at least one roof panel such that said at least one roof connection plate is adjacent a roof panel end;

forming a horizontal floor panel;

placing the exterior wall panels upright and end to end on said floor panel to define an enclosure such that connection plates of adjacent wall panels register with and are immediately adjacent to each other;

welding adjacent said wall panel connection plates together to secure said exterior wall panels in their positions relative to each other;

placing said at least one roof panel across and on top of a plurality of said exterior wall panels such that roof panel connection plates register with and are immediately adjacent to wall panel connection plates;

and welding adjacent said at least one wall panel and roof panel connection plates together to secure said at least one roof panel and said exterior wall panels in their positions relative to each other to define a concrete building module.

2. The method of claim 1, comprising the additional steps of:

pre-casting with concrete at least one interior wall panel having interior wall panel faces and interior wall panel ends with the plate anchor means of at least one wall panel connection plate embedded in a face of the at least one interior wall panel such that the connection plate is adjacent to an interior wall panel end;

placing said at least one interior wall panel within the enclosure defined by the exterior wall panels to define a module interior wall, such that said at least one wall panel connection plate of said interior wall panel registers with and is immediately adjacent to one of: a wall panel connection plate of another interior wall panel and an wall panel connection plate of one of said exterior wall panels;

and welding the adjacent said plate connection means together to secure said at least one interior wall panel in its position relative to said exterior wall panels.

3. A method of constructing a concrete building module, comprising the steps of:

providing a plurality of plastic connection plates comprising groups of wall panel connection plates and roof panel connection plates, each connection plate having a plate connection means and a plate anchor means;

pre-casting with concrete a plurality of exterior wall panels having exterior wall panel faces and exterior wall panel ends with the plate anchor means of at least one said wall panel connection plate embedded in an exterior wall panel face of each at least one exterior wall panel such that the wall panel connection plate is adjacent an exterior wall panel end;

pre-casting with concrete at least one roof panel having roof panel faces and roof panel ends with the plate anchor means of at least one said roof connection plate embedded in a roof panel face of said at least one roof panel such that said at least one roof connection plate is adjacent a roof panel end;

forming a horizontal floor panel;

placing the exterior wall panels upright and end to end on said floor panel to define an enclosure such that connection plates of adjacent wall panels register with and are immediately adjacent to each other;

melting adjacent said wall panel connection plates together to secure said exterior wall panels in their positions relative to each other;

placing said at least one roof panel across and on top of a plurality of said exterior wall panels such that roof panel connection plates register with and are immediately adjacent to wall panel connection plates;

and melting adjacent said at least one wall panel and roof panel connection plates together to secure said at least one roof panel and said exterior wall panels in their positions relative to each other to define a concrete building module.

4. A method of constructing a concrete building module, comprising the steps of:

providing a plurality of connection plates comprising groups of wall panel connection plates and roof panel connection plates, each connection plate having a plate connection means and a plate anchor means;

pre-casting with concrete a plurality of exterior wall panels having exterior wall panel faces and exterior wall panel ends with the plate anchor means of at least one said wall panel connection plate embedded in an exterior wall panel face of each at least one exterior wall panel such that the wall panel connection plate is adjacent an exterior wall panel end;

pre-casting with concrete at least one roof panel having roof panel faces and roof panel ends with the plate anchor means of at least one said roof connection plate embedded in a roof panel face of said at least one roof panel such that said at least one roof connection plate is adjacent a roof panel end;

forming a horizontal floor panel;

placing the exterior wall panels upright and end to end on said floor panel to define an enclosure such that connection plates of adjacent wall panels register with and are immediately adjacent to each other;

securing adjacent said wall panel connection plates together to secure said exterior wall panels in their positions relative to each other;

placing said at least one roof panel across and on top of a plurality of said exterior wall panels such that roof panel connection plates register with and are immediately adjacent to wall panel connection plates;

and securing adjacent said at least one wall panel and roof panel connection plates together to secure said at least one roof panel and said exterior wall panels in their positions relative to each other to define a concrete building module.

* * * * *